United States Patent [19]

Galasso

[11] Patent Number: 4,896,441

[45] Date of Patent: Jan. 30, 1990

[54] REMOVABLE INNERSOLE FOR FOOTWEAR

[76] Inventor: Riccardo Galasso, Via Toscanini, 11-Cadoneghe (Padova), Italy

[21] Appl. No.: 194,304

[22] Filed: May 16, 1988

[30] Foreign Application Priority Data

May 22, 1987 [IT] Italy ..... 47973 A/87

[51] Int. Cl.[4] ..... A43B 13/38; A43B 13/40

[52] U.S. Cl. ..... 36/43; 36/3 B; 128/581

[58] Field of Search ..... 36/43, 44, 3 R, 3 B, 36/28, 29; 128/586, 581

[56] References Cited

U.S. PATENT DOCUMENTS

| | | | |
|---|---|---|---|
| 2,090,881 | 8/1937 | Wilson | 36/29 |
| 2,146,888 | 2/1939 | Fisch | 36/3 B |
| 2,327,360 | 8/1943 | Margolin | 36/3 B |
| 3,274,708 | 9/1966 | Lukas | 36/3 R |
| 3,418,731 | 12/1968 | Anciaux | 36/3 B |
| 4,733,483 | 3/1988 | Lin | 36/28 |

FOREIGN PATENT DOCUMENTS

| | | | |
|---|---|---|---|
| 0215995 | 4/1987 | European Pat. Off. | 36/29 |
| 3228017 | 7/1983 | Fed. Rep. of Germany | 36/3 R |
| 1511344 | 12/1967 | France | 36/43 |
| 52-2646 | 1/1977 | Japan | 36/3 B |
| 652894 | 12/1985 | Switzerland | 36/43 |

*Primary Examiner*—James Kee Chi

*Attorney, Agent, or Firm*—Bucknam and Archer

[57] ABSTRACT

A removable innersole for footwear is provided on the surface which is intended to be the underside, resting on the internal surface of the shoe, with a plurality of elements (1) made of elastic material. These elements are arranged preferably in transversal rows and may have different transversal dimensions, different height and different hardness in the different parts of the innersole. The new innersole permits to achieve a better distribution in the weight of the user along the entire surface of the inner sole.

4 Claims, 4 Drawing Sheets

REMOVABLE INNERSOLE FOR FOOTWEAR

The present invention relates to an innersole for shoes and more specifically the type of inner sole which has the shape of the sole of the shoe itself and is suitable to be inserted into the shoe in a manner which is removable.

According to the state of the art, the innersole is made of a material which is sufficiently soft and elastic so as to permit better walking by the user and/or to correct eventual defects in the feet of the user such as for instance lowered metatarsal bones, calcanei protrusions and other defects. Presently these innersoles are made of plastic material or of cloth or non-woven material and in general material which is soft to serve as a cushion. The known innersoles have the main purpose of distributing in the most uniform possible manner the static and dynamic pressure exerted by the foot through the shoe on the ground so as to relieve the fatigue encountered by the user during walking and relieve the user of the pain in the feet after walking.

There are also known some anatomical and/or orthopedic innersoles which serve the purpose of contributing to overcome real pathological conditions of the user which make walking particularly difficult. For this purpose some substances have been used, such as foamed and blown rubber which permit an adequate conformation of the innersole which becomes adapted to the particular shape of the bottom of the foot of the user.

The innersole of common usage as well as the orthopedic innersole presents occasionally a variable thickness along their transversal and longitudinal line with respect to the particular requirements of the user, but in any event they present a smooth surface corresponding to both the lower and upper faces. In addition, there are commercially available shoes and sandals which present corresponding to the surface of the sole which is placed internally into the shoe and the sandal a plurality of elements of cylindrical shape placed along the entire surface on which practically the bottom of the foot of the user comes to rest. These elements serve the purpose of permitting the massage of the bottom of the foot of the user, particularly when the latter walks, while they do not contribute at all to distribute the weight of the user on a larger surface on which to rest. Further, they cannot serve as correction elements for eventual defects of the foot of the user.

An object of the present invention is to provide an innersole for shoes which is removable, due to which it is possible to obtain a better distribution of the weight of the user with respect to what is obtainable with the normal and orthopedic known innersoles.

The crux of the present invention resides in providing on the surface of the innersole which is intended to be the underside, that is corresponding to the surface placed internally into the shoe, a plurality of protruding elements, preferably of cylindrical shape.

The diameter, the height and the arrangement of these elements are determined according to the physical characteristics of the user of the shoe for whom the innersole is intended as well as the type of activity which this individual intends to carry out.

More specifically, the innersole may be made of a material of variable hardness corresponding to the different parts and more specifically the hardness of the rear parts is advantageously greater than the hardness of the front parts for the purpose of compensating the greater weight which obviously has a tendency to be felt more on the former rather than the latter.

Further, the device of the present invention permits the orthopedic expert to adapt it so that it may serve as a correction element for defects in the feet of the user. These corrections may be achieved by injecting silicone material between the various protruding elements or by elimination of one or more of the elements of cylindrical shape of the innersole or by inserting rigid elements placed axially within the cylindrical elements.

The present invention is illustrated further with reference to the accompanying drawings which are given by way of example but are not intended to limit the scope of the invention.

FIGS. 1 and 2 represent respectively a top view and a side view of a first embodiment of the invention.

FIGS. 3 and 4 respectively represent a top view and a side view of a second embodiment of the invention.

Figure 1:
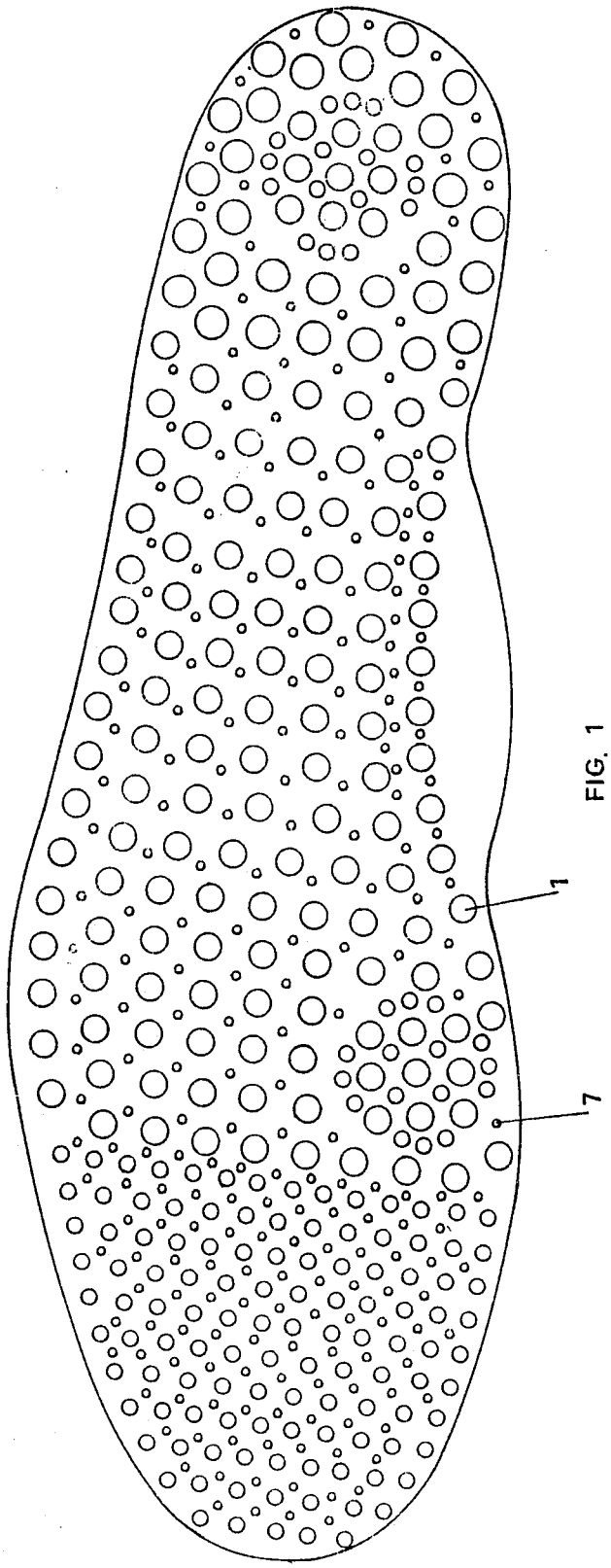
Figures 3, 4:
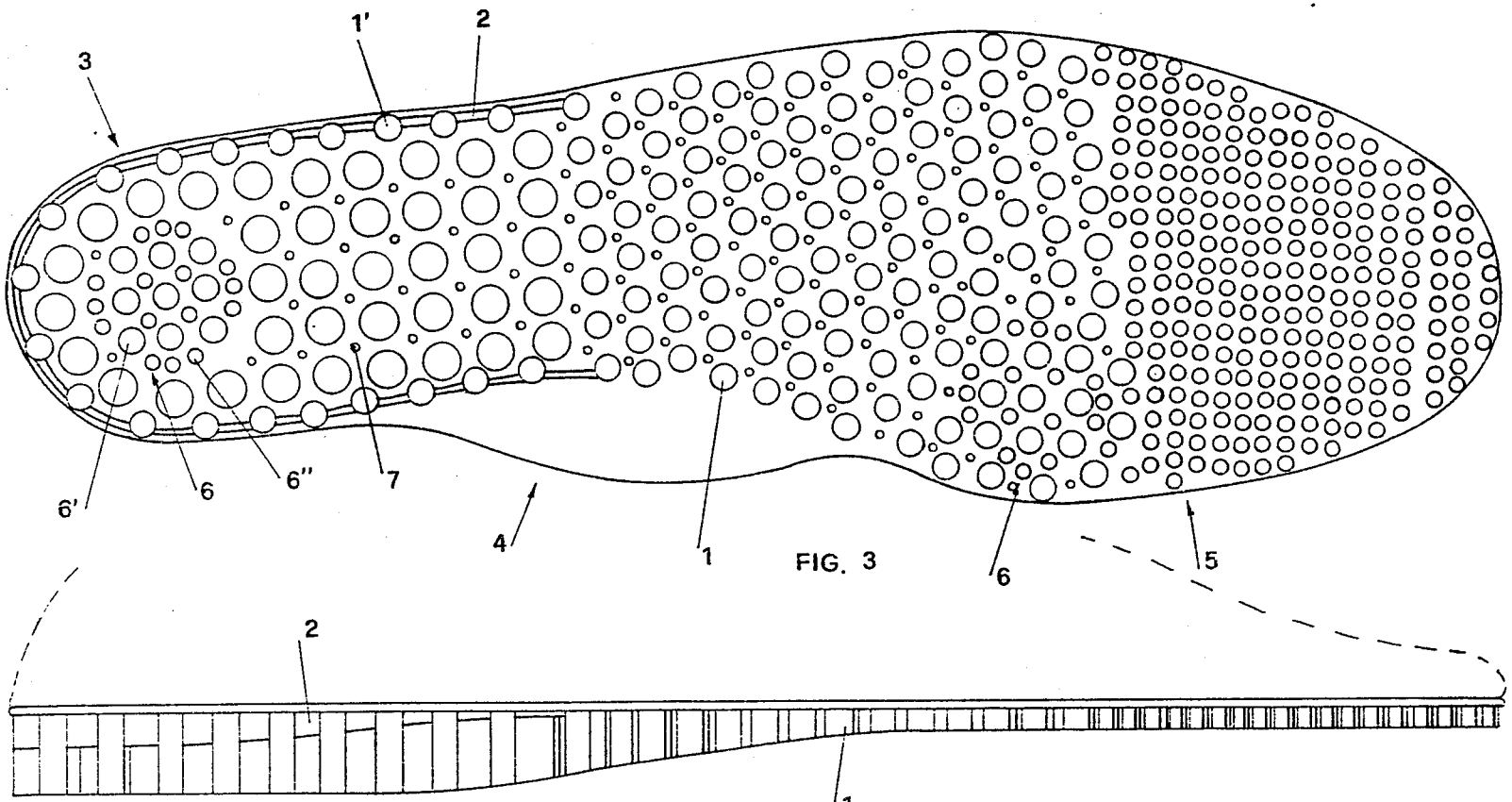

FIGS. 1 and 3 show the innersole of the present invention which, corresponding to the surface which is placed in the bottom part, on the surface placed internally with respect to the sole of the shoe, has a plurality of elements (1) of cylindrical shape which emerge vertically from the surface itself and are fixed to it. These elements are preferably made integrally with the same surface. These elements are present along the entire surface and are disposed mostly arranged in rows with a substantial transversal direction.

Figure 2:
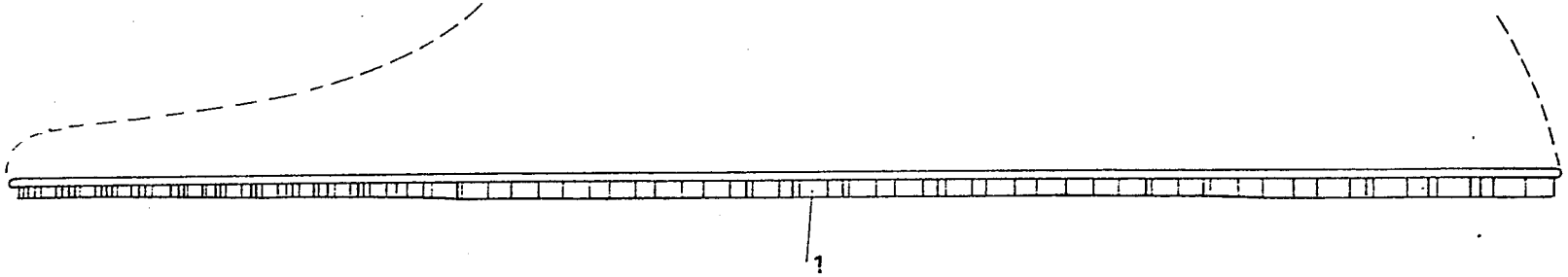

Obviously, the numbers, dimensions and the disposition of these elements depend upon the use for which the innersole is intended. Specifically, these elements are in great number and in greater dimensions if they are intended to be used for sport shoes or work shoes and in ggeneral for people of substantial weight as shown in FIGS. 3 and 4, while they will be in a smaller number and with smaller dimensions when the innersole is to be used in normal walking shoes and in general for people of modest weight as shown in FIGS. 1 and 2. In the first case it is advantageous to join the elements (1') placed along the borders of the innersole in the area of the heel by means of segments (2) of a height smaller with respect to the same elements. These segments are disposed perpendicularly with respect to the surface of the innersole and they serve the purpose of reinforcing the rear portion of the structure and reducing to the minimum the component of the force exerted by the user on the shoe towards the exterior.

The height of the elements (1) further may be substantially constant along the entire longitudinal border of the inner sole as shown in FIGS. 1 and 2 or as shown in FIG. 4, it may be of decreasing height from the rear towards the front portion of the inner sole.

The invention is advantageously carried out by means of a mixture of thermoplastic elastic materials by pressing. Further, a single inner sole may be made with two, three or even more materials of variable hardness corresponding to the different portions. In actual practice, it is preferable that the portion (3) which corresponds to the heel (4) be harder than the intermediate portion (4) and the front portion (5). Also, the hardness of the elements of these two zones may vary and may be particularly greater corresponding to the intermediate portion (4). By way of example and without limitation with respect to the scope of the invention, the table hereinbelow gives the hardness expressed in Shore units inherent to the materials used for the preparation of the inner soles intended to be used by people of different weight.

| | Heel | Intermediate portion and front portion |
|---|---|---|
| Kg. 60–75 | 42 | 32 |
| Kg. 80–95 | 46 | 36 |
| Kg. 95–110 | 50 | 38 |

As shown in FIGS. 1 and 3 in the portions of the inner sole which are under greater pressure and specifically in the portion of the heel and in the portion of the first metatarsal bone, the elements (1) are grouped so as to form a configuration (6) of circular shape formed by a plurality of elements (6') disposed to form the sides and the internal part of a square structure and other elements (6'') of smaller transversal dimensions which are inserted in the interstices and externally with respect to the structure.

Figure 6:
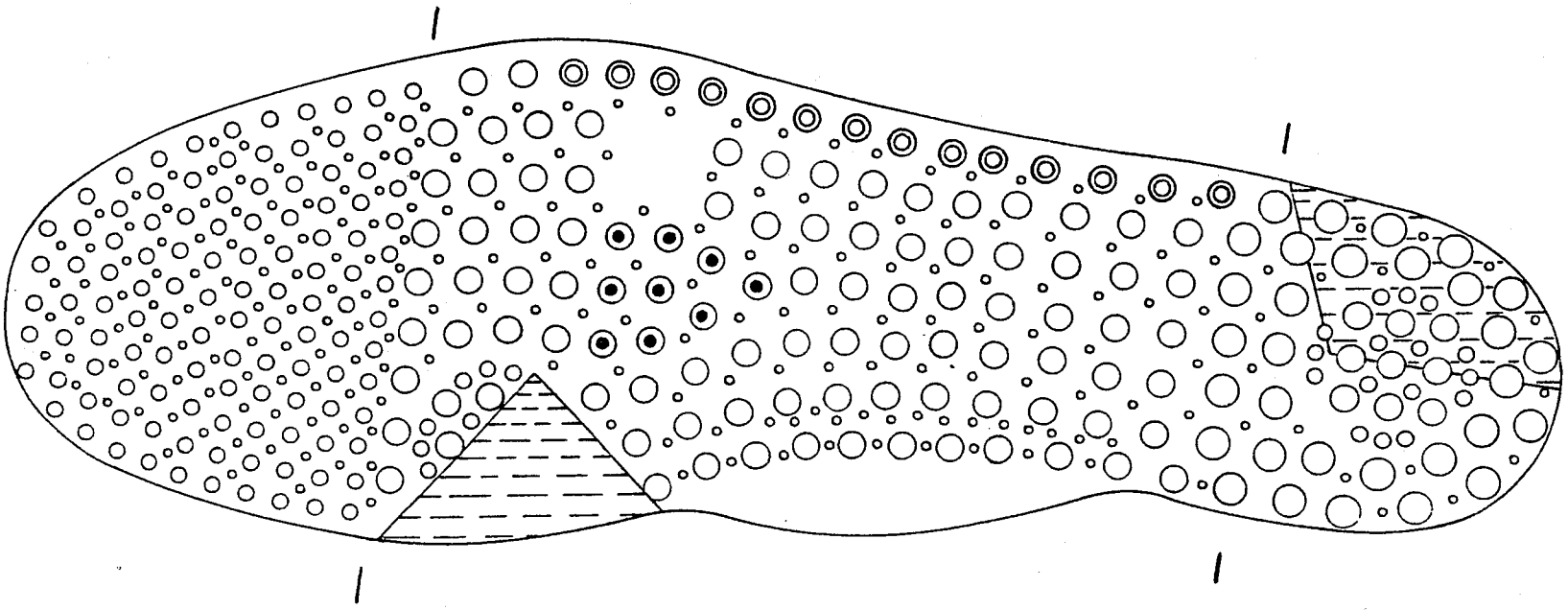
FIG. 6 illustrates the elements (1) arranged in groups of different hardness, the space between a plurality of adjacent elements being injected with silicone material, at least one portion of the sole being devoid of elements, a rigid element being inserted into at least one element and the elements being internally hollow.

The invention in addition is particularly suitable to serve as a correction means for eventual defects of the user. These corrections which obviously must be prescribed by an orthopedic doctor, may be obtained for instance by injection of a silicone material between the different elements or by eliminating some of the elements (1) or by insertion of elements made of rigid material longitudinally within the elements (1) Numeral 11 in FIG. 6 designates the area in which elements (1) have been eliminated. Numeral (12) designates the embodiment in which a rigid material is inserted within the elements (1). Numeral 13 designates solid elements (1) and numeral (14) designates the hollow elements. Numeral (10) designates the area in which elements of different hardness are arranged in groups.

The elements (1) may also assume shapes different from the shapes shown in the figures and they may be hollow or solid. They may also form a unitary body with the surface from which they emerge but they must always remain fixed to the surface. In addition, they may present transversal dimensions which are different or the same on a single inner sole.

FIGS. 1 and 3 show orifices (7) which are used to provide sufficient aeration in the lower part of the foot.

Figure 5:
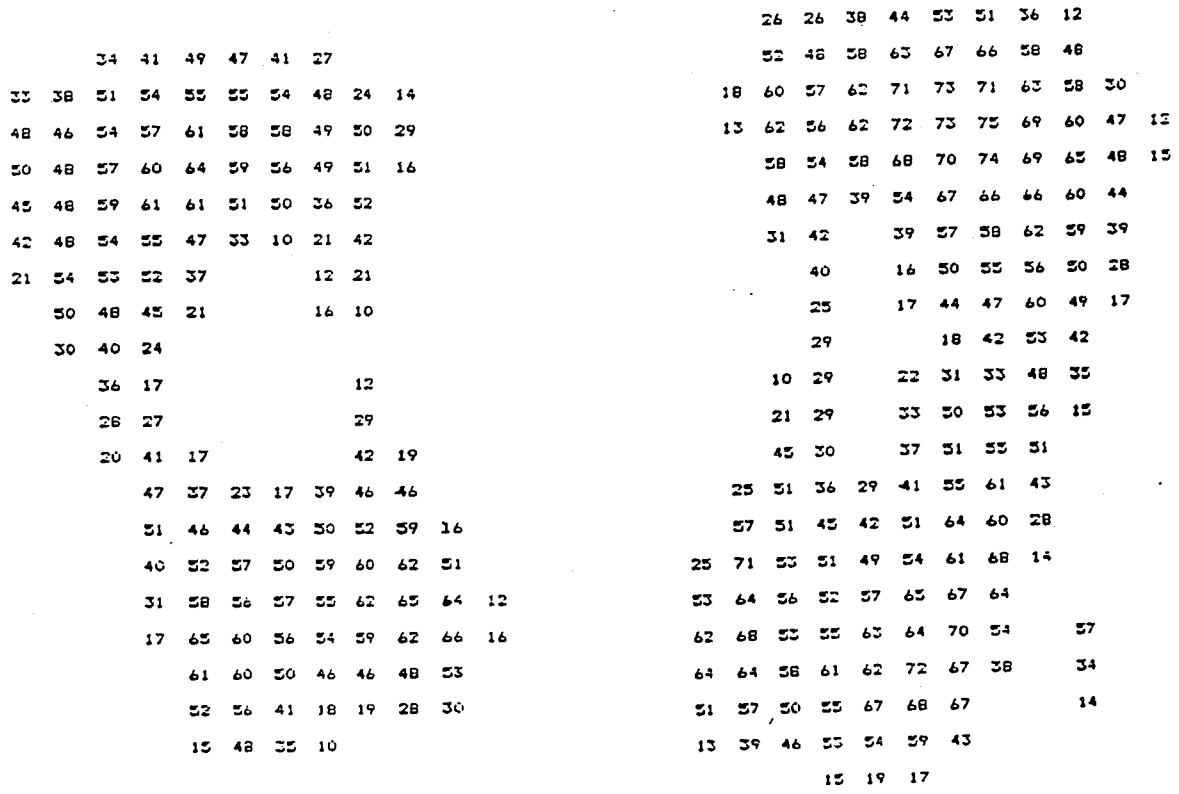
FIG. 5 illustrates a diagram of the values of the pressure exerted by the bottom part of the foot on the ground in the case of an individual who is wearing on the left foot an anatomical innersole and on the right foot the innersole according to the invention.

Some comparative tests have been carried out between the devices according to the present invention and the anatomical inner soles known in the art. These tests have resulted among others in the diagram of FIG. 5 in which the pressure is expressed in arbitrary units corresponding to a substantial number of portions of the ground by the individual who is using on the left foot a known anatomical inner sole and is using on the right foot the inner sole according to the invention. This diagram shows that the inner sole of the invention permits to distribute the weight along a surface which is much greater with respect to known anatomical inner soles. These results permit to conclude that the device according to the present invention permits to distribute the weight of the individual in a manner substantially superior with respect to what has been possible with known inner soles of anatomical type and that it also permits improved well-being to the individual both in the static as well as in the dynamic phase. Finally, the device according to the present invention is particularly useful in the prevention of defects as well as in the phase of therapy of malformations of the feet of the individual.

What is claimed is:

1. A removable inner sole for footwear of the shape of the internal part of the shoe within which it is intended to be inserted, said inner sole having on the surface to be arranged at the bottom a plurality of solid elements (1), said elements protruding vertically towards the exterior and wherein in the area corresponding to the heel of the foot said elements (1) are arranged to form a circular structure (6) formed by a plurality of elements (6') of greater transversal dimensions disposed along the lateral borders and in the interior of a square structure, and a plurality of elements (6'') of smaller transversal dimensions are interposed between said elements (6') and said elements (6'') surround said elements (6'), and wherein said elements (1) are grouped in at least three groups of different hardness, said groups being arranged respectively according to the degree of hardness corresponding to the rear zone (3), corresponding to the intermediate zone (4) and corresponding to the front zone (5).

2. The inner sole according to claim 1 wherein a plurality of elements (1') are placed in the rear portion of the inner sole along the external border, said elements being joined among themselves by segments (2) arranged perpendicularly with respect to the surface of said inner sole.

3. The inner sole according to claim 1 wherein in the space between a plurality of adjacent elements (1) a silicone material is injected.

4. A removable inner sole for footwear of the shape of the internal part of the shoe within which it is intended to be inserted, said inner sole having on the surface to be arranged at the bottom a plurality of hollow elements (1), said elements protruding vertically towards the exterior and wherein in the area corresponding to the heel of the foot said elements (1) are arranged to form a circular structure (6) formed by a plurality of elements (6') of greater transversal dimensions disposed along the lateral borders and in the interior of a square structure, and a plurality of elements (6'') of smaller transversal dimensions are interposed between said elements (6') and said elements (6'') surround said elements (6'), and wherein said elements (1) are grouped in at least three groups of different hardness, said groups being arranged respectively according to the degree of hardness corresponding to the rear zone (3), corresponding to the intermediate zone (4) and corresponding to the front zone (5).

* * * * *